US005798490A

United States Patent [19]

Vairio et al.

[11] Patent Number: 5,798,490

[45] Date of Patent: Aug. 25, 1998

[54] PROCEDURE AND APPARATUS FOR DETERMINING THE POSITION OF AN ELEVATOR CAR

[75] Inventors: Olavi Vairio; Jarmo Mäenpää, both of Hyvinkää; Seppo Suur-Askola, Riihimäki, all of Finland

[73] Assignee: Kone Oy, Helsinki, Finland

[21] Appl. No.: 813,012

[22] Filed: Mar. 5, 1997

Related U.S. Application Data

[63] Continuation of Ser. No. 365,130, Dec. 28, 1994, abandoned.

[30] Foreign Application Priority Data

Dec. 28, 1993 [FI] Finland ..... 935909

[51] Int. Cl.[6] ..... B66B 1/42; B66B 1/34

[52] U.S. Cl. ..... 187/394; 187/284; 187/283

[58] Field of Search ..... 187/283, 394, 187/391, 284

[56] References Cited

U.S. PATENT DOCUMENTS

| | | | |
|---|---|---|---|
| 3,889,231 | 6/1975 | Tosato et al. | 340/21 |
| 4,083,430 | 4/1978 | Gingrich | 187/29 R |
| 4,495,953 | 1/1985 | Bennewitz | 128/789 |
| 4,658,935 | 4/1987 | Holland | 187/122 |
| 4,750,592 | 6/1988 | Watt | 187/134 |
| 4,756,389 | 7/1988 | Sakata et al. | 187/134 |
| 4,798,267 | 1/1989 | Foster et al. | 187/28 |
| 5,459,399 | 10/1995 | Durand et al. | 324/207.24 |

FOREIGN PATENT DOCUMENTS

| | | | |
|---|---|---|---|
| 911677 | 10/1992 | Finland | B66B 3/02 |
| 3-67881 | 3/1991 | Japan | 187/394 |
| 2201656 | 9/1988 | United Kingdom | B66B 1/40 |

*Primary Examiner*—Robert Nappi

[57] ABSTRACT

A procedure for determining the position of an elevator car in which the code data contained in code units mounted in the building is read by means of a code data detector unit (4) in such manner that a code unit containing floor data and door zone data is mounted essentially close to the threshold of the landing door on each floor and that the detector unit reading the floor data and door data is mounted essentially close to the threshold of the car.

22 Claims, 3 Drawing Sheets

PROCEDURE AND APPARATUS FOR DETERMINING THE POSITION OF AN ELEVATOR CAR

This application is a continuation, of application Ser. No. 08/365,130 filed on Dec. 28, 1994, now abandoned.

The present invention relates to a procedure and an apparatus for determining the position of an elevator car.

As an example of known technology, a deviation detector producing a linear function of the output deviation is mounted in a vertical position on the, car threshold while the magnets used as its counterparts are mounted on the landing thresholds. When the magnet lies at the middle of the measurement range of the detector, the thresholds are in exact alignment relative to each other.

In a normal situation, the movement of the elevator car is monitored by means of a tachometer and a pulse counter, and the position of the elevator car is obtained by comparing the counter value to a floor table stored in memory. In an abnormal situation, e.g. after a power failure, it is necessary to verify the correctness of the initial value of the pulse counter. This can be done by performing a so-called synchronizing drive, which means driving the elevator to a certain floor. Floor-specific codes are generally not provided for all floors, in which case the elevator is driven e.g. to the bottom floor, where a separate switch is provided. This method is slow because the driving distance may be quite long.

In the case of automatic doors, the doors are opened by applying an advance opening system and fine adjustment after the doors have been opened. To ensure safe operation, so-called door zone signals are used, usually two signals for each floor; in other words, each floor is provided with two non-safety switches providing information about the car position. In the description below, these signals are referred to as door zone I and door zone II.

The object of the invention is to develop a new procedure for determining the position of an elevator car. The procedure of the invention is characterized in that the code data contained in code units mounted in the building is read by means of a code data detector unit in such manner that a code unit containing floor data and door zone data is mounted essentially close to the threshold of the landing door on each floor and that the detector unit reading the floor data and door data is mounted essentially close to the threshold of the car.

A solution according to the invention is characterized in that a linear transducer generating position data for accurate levelling is fitted in the detector unit.

Another solution according to the invention is characterized in that the floor data is encoded in a magnetic code plate.

A solution according to the invention is characterized in that the detector units are implemented using magnetic detectors which read the code plates.

A solution according to the invention is characterized in that the detector unit is also used for checking a position counter contained in a processor.

The apparatus of the invention is characterized in that a code unit containing floor data and door zone data is mounted essentially close to the threshold of the landing door on each floor and that a detector unit for reading the floor data and door zone data is mounted in the car essentially close to the threshold of the car.

Another embodiment of the invention is characterized in that a base plate carrying the magnets of a linear position transducer and coding magnets containing the floor data and a door zone magnet array is mounted in the shaft near a landing, and that a detector unit mounted near the threshold of the car correspondingly contains a magnetic linear position transducer, code detectors and door zone detectors.

The advantages achieved by combining the floor-specific positioning devices into a single assembly that is easy to install include the following:

- the elevator stops exactly at the level of the landing
- oscillator switches and vane lines can be left out, and so can the associated installation work
- position adjustment can be used during an accurate levelling drive
- installation costs are reduced and installation becomes easier
- installation time is reduced and no readjustment is needed
- adjustment errors resulting from rope elongation can now be taken into account
- instead of a single high-quality detector, two simple detectors can be used
- the data is carried by a current signal, which is less sensitive to interference than a voltage signal
- positioning devices can now be mounted on the car and landing thresholds
- when a linear position transmitter is used, more accurate feedback for adjustment is obtained at the end of the deceleration phase.

In the following, the invention is described in detail by the aid of some examples of its embodiments by referring to the attached drawings, in which

DETAILED DESCRIPTION OF THE PREFERRED EMBODIMENTS

Figure 1:
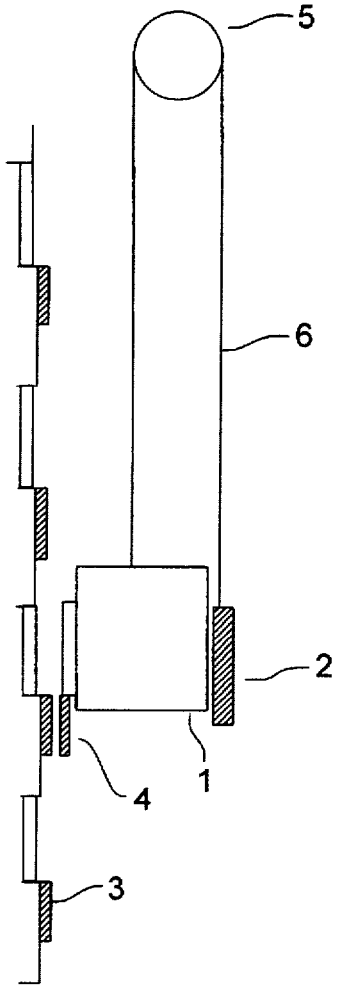
FIG. 1 presents the layout of a code plate containing magnets and the detectors responding to the magnets in the elevator system.
Figure 3:
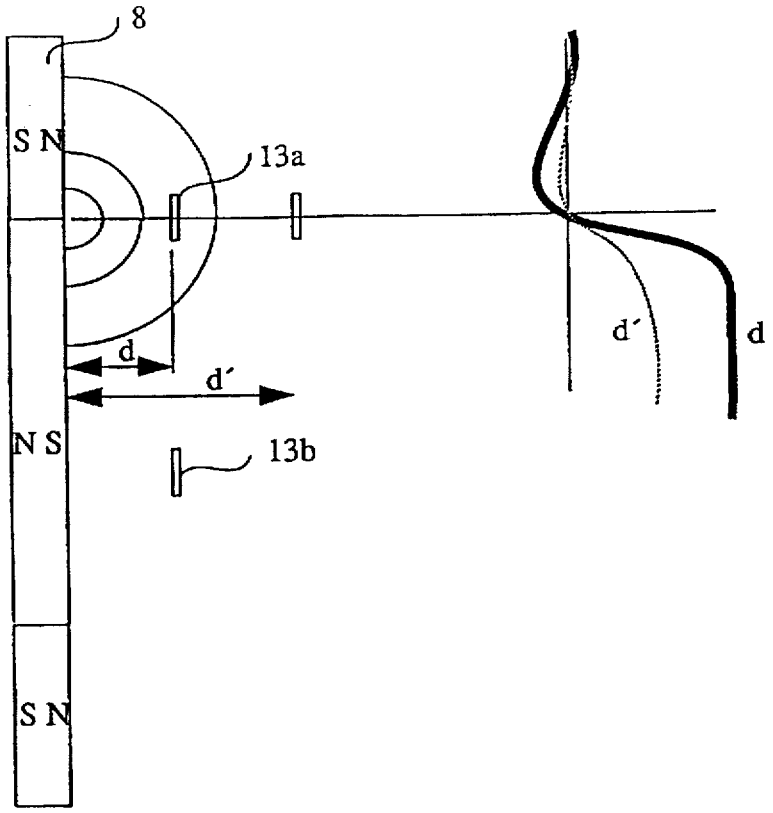
FIG. 3 illustrates the principle of the door zone I detector.

FIG. 1 shows an elevator car 1, a counterweight 2 and a rope 6 running over a traction sheave 5. The position of the elevator car 1 is determined by means of a magnetic code plate 3 in which a code identifying the floor is encoded. The code plate functions as a code unit. It is fastened with two screws below the landing and is placed in the threshold of the landing door. The detector unit used is a unit 4 sensitive to a magnetic field and it contains a linear position transmitter 12 in the car, detectors **13*a* and 13*b* and detectors 22, 23 and 24. The detector unit 4 is placed in the threshold of the car door. Door zone I receives information from an elongated magnet as shown in FIG. 3 by means of detectors 13*a* and 13*b*, and door zone II receives information from the code magnets in FIG. 5 via detectors 24**. A common method to produce door zone signals is to use magnetic or inductive switches.

Figure 2:
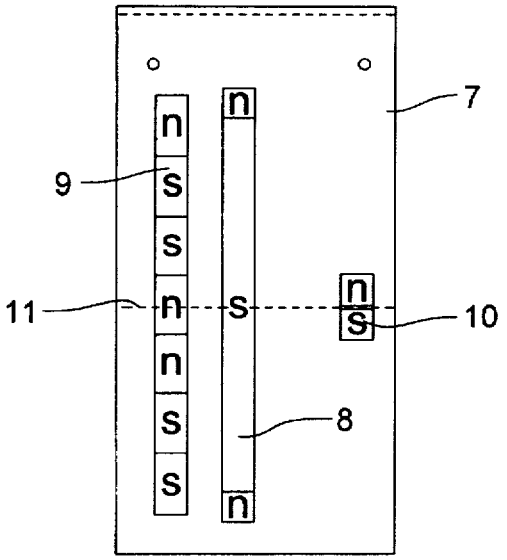
FIG. 2 presents the positions of the magnets on the code plate, made of an iron plate.

In FIG. 2, the magnets are placed on an iron backplate 7. The magnet array for door zone I is indicated by number 8.

The coding of door zone II is done with magnets 9. Magnets 10 are the magnets of the linear position transmitter 12. The magnets are placed symmetrically with respect to the mid-line 11. Magnetic detectors are used for the reading of the code plate. The linear transducer consists of a linear position transmitter 12 and the code unit consists of a code plate.

FIG. 3 illustrates the operation of the detector of door zone I. The code plate contains magnets 8 placed on a back-plate 7. Each magnet 8 consists of three separate magnets so arranged that there is a shorter magnet at each end and a longer one between them. The detector unit 4 contains two direction sensing detectors 13*a* and 13*b* which are so placed that the switching point or 0-point of the detectors 13 is independent of the distance between the magnet 8 and the detectors 13. This zero point lies within the curve pattern comprising curves d and d' in FIG. 3, which represent the distances between the magnet 8 and the detectors 13. In express zones, the elevator position is monitored using so-called ghost floors, which have no door zone magnets. Therefore, the opening of the doors at a ghost floor is inhibited. 'Express zones' means floors in a high-rise building which the elevator passes by without stopping. The elevator may only stop at the top and bottom floors and pass by the floors in between. These intermediate floors are called an express zone.

Figure 4:
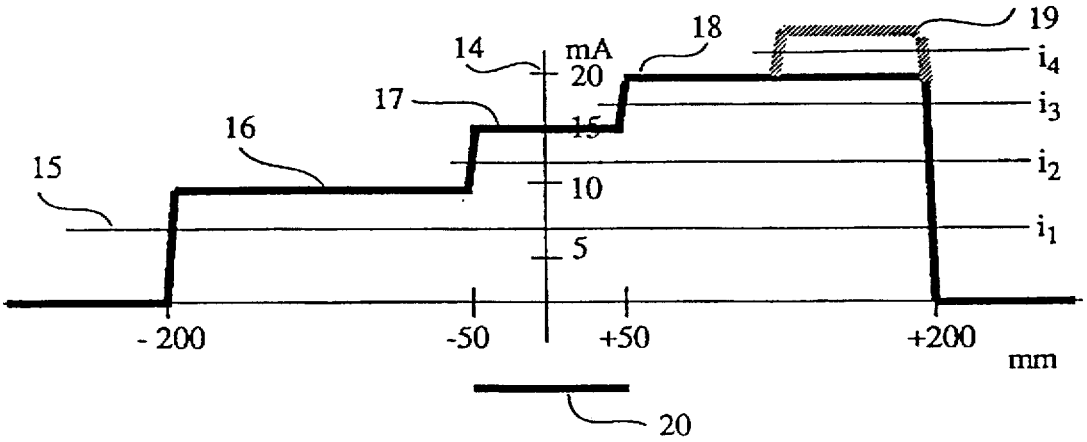
FIG. 4 presents the current signal of door zone I.

FIG. 4 presents the current signal 14 of door zone I. The coding of the door zone into a current signal is effected by transmitting the following information through a wire in the car cable:

- elevator is in door zone 15 ($i>i_1$); purpose: to bypass the safety circuit during accurate levelling and advance opening
- elevator is within the operating range 17 ($i_3>i>i_2$) of the linear position transmitter, detectors 13*a* and 13*b* are both active
- elevator is below 16 the operating range of the linear position transmitter ($i_2>i>i_3$), only detector 13*a* is active
- elevator is above 18 the operating range of the linear position transmitter ($i_4>i>i_3$), only detector 13*b* is active
- elevator is in door zone (walk-through car) and door zones overlap 19 ($i>i_4$).

The expression 'door zones overlap' means that the building consists e.g. of a new part and an old part and the elevator is placed between them. The floors in the old part may lie at different levels than the floors in the new part, in which case the elevator is first driven e.g. to the level of a floor in the new part and then maybe some 300 mm downwards to a floor in the old part. The data regarding the operating range 17 of the linear position transmitter can also be used as a so-called interior door zone 20. The interior door zone is used for accurate levelling (according to US regulations).

Figure 5:
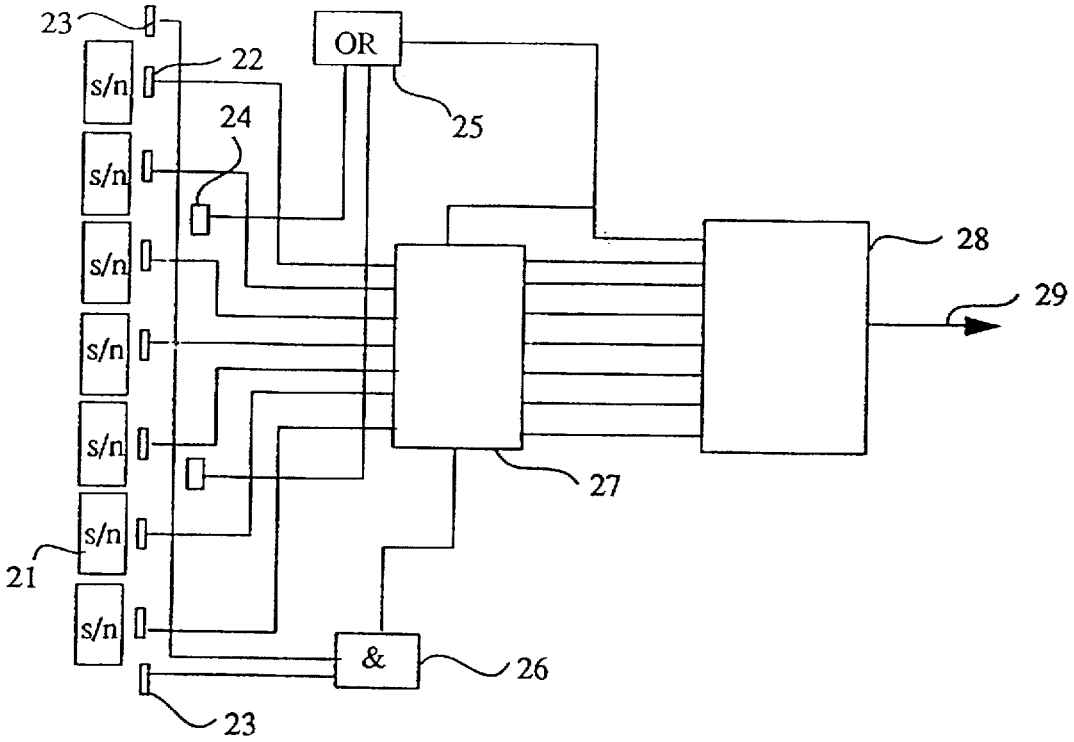
FIG. 5 presents door zone II, implemented using a series of magnets carrying the code of the floor

In FIG. 5, door zone II is implemented using a magnet array 21 in which the floor code is encoded. With this system, no synchronizing drive is needed after a power failure. The door zone data itself, which indicates that the elevator is in door zone II, is obtained via an OR gate 25 from detectors 24, which are independent of the polarities of the magnets 21. In FIG. 5, the floor code is obtained with nine detectors 22 and 23. The outermost detectors 23 give a triggering signal to an &-gate 26 which is used to transfer the floor code provided by the seven intermediate detectors 22 into memory 27. A converter 28 transmits the door zone data II and the floor code in the form of a current signal 29 to a control processor. The floor code is encoded as a binary number in the magnetic code plate 3 by changing the polarity.

Figure 6:
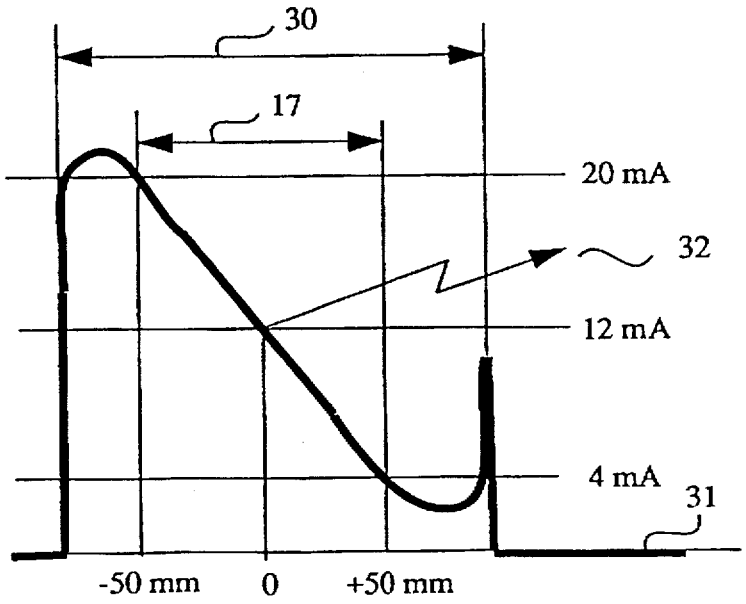
FIG. 6 presents the current signal obtained from a linear position transmitter.

FIG. 6 presents the current signal of the linear position transmitter (not shown in the figures) or linear transducer in the detector unit 4. The current is zero when there is no magnet near 31 the position transmitter. When a magnet appears in the range of the position transmitter, the signal is activated 30. The current signal 14 of door zone I provides the required information regarding the linear operating range 17 of the position transmitter. At the zero point of the position transmitter, the processor is given an interrupt 32, which is used to check the value of the position counter in the processor. The processor calculates the car position by means of its position counter. An interrupt means that the operation of the processor can be interrupted by a signal. The zero point is so defined that its value is 12 mA. This is an example frequency, called the standard signal.

It is obvious to a person skilled in the art that different embodiments of the invention are not restricted to the examples described above, but that they may instead be varied within the scope of the claims presented below. The invention may be implemented using different types of magnets, e.g. plastic magnets, and the polarities of the magnets can be changed, as well as capacitive and optic detectors.

We claim:

1. A method for determining the position of an elevator car, comprising the steps of:

providing code data contained in code units mounted in the building; and reading the code data by means of a code data detector unit mounted on the car, wherein the code unit contains floor data and door zone data and is mounted at the threshold of the landing door on each floor, and the door zone data includes a first magnet extending in a direction of movement of the car in an elevator shaft, the first magnet being adjacent a second magnet at one end and adjacent a third magnet at an opposite end, the second and third magnets being of opposite polarity than the first magnet, and further wherein the detector unit reading the floor data and door data is mounted at the threshold of the car.

2. The method for determining the position of an elevator car according to claim 1, further comprising the step of generating position data for accurate levelling by means of a linear transducer fitted in the detector unit.

3. The method for determining the position of an elevator car according to claim 1, wherein the floor data is magnetically encoded in a code plate.

4. The method for determining the position of an elevator car according to claim 3, wherein the detector unit uses magnetic detectors to read the code plate.

5. The method for determining the position of an elevator car according to claim 3, wherein the detector unit is also used for checking a position counter.

6. An apparatus for determining the position of an elevator car, comprising:

a code unit, containing positioning magnets and a door zone magnet array, mounted at the threshold of the landing door on each floor;

a detector unit for reading the door zone magnet array, mounted in the car at the threshold of the car; and a position transmitter for detecting the positioning magnets and producing a signal indicating how far the elevator car is from being level with the threshold of the landing door, wherein said detector unit includes a plurality of door zone detectors, said door zone detectors detecting the magnetic field of the door zone magnet array and producing a first signal when the car is within a first door zone and a different signal when the car is within a second door zone, the first door zone and the second door zone being independent.

7. The method for determining the position of an elevator car according to claim 2, wherein the floor data is magnetically encoded in a code plate.

8. The method for determining the position of an elevator car according to claim 2, wherein the detector unit is also used for checking a position counter.

9. The method for determining the position of an elevator car according to claim 3, wherein the detector unit is also used for checking a position counter.

10. The method for determining the position of an elevator car according to claim 4, wherein the detector unit is also used for checking a position counter.

11. The method for determining the position of an elevator car according to claim 1, wherein the detector unit provides, in said reading step, a current of a first magnitude when the elevator car is within a first door zone, a current of a second magnitude when the elevator car is within a second door zone, and a current of a third magnitude when the elevator car is within a third door zone, the second door zone being located below the first door zone and the third door zone being located above the first door zone.

12. The method for determining the position of an elevator car according to claim 11, wherein the third magnitude is greater than the second magnitude, and the second magnitude is greater than the first magnitude.

13. The method for determining the position of an elevator car according to claim 1, wherein, as considered in a direction of movement of the car in an elevator shaft, the first magnet has a first length and the second and third magnets have lengths shorter than the first length.

14. The method for determining the position of an elevator car according to claim 13, wherein the door zone data consists of the first, second, and third magnets.

15. The apparatus for determining the position of an elevator car according to claim 6, wherein said code unit further includes floor coding magnets identifying the landing, and said detector unit includes a plurality of code detectors equal in number to said floor coding magnets, said code detectors detecting each of said floor coding magnets and producing a signal identifying the landing.

16. The apparatus for determining the position of an elevator car according to claim 6, wherein said door zone detectors detect the magnetic field of the door zone magnet array and produce a current of a first magnitude when the car is within a first door zone and a current of a second magnitude when the car is within a second door zone, the first door zone being within the second door zone.

17. The apparatus for determining the position of an elevator car according to claim 6, wherein said positioning magnets consists of a pair of magnets of opposite polarity, the pair of magnets being arranged adjacent one another as considered in a direction of movement of the elevator car.

18. The apparatus for determining the position of an elevator car according to claim 6, wherein said linear position transmitter produces a current which is proportional to a distance from the elevator car to a position level with the threshold of the landing door.

19. The apparatus for determining the position of an elevator car according to claim 18, wherein said first door zone overlaps an area where said current produced by said linear position transmitter is proportional with the distance.

20. The apparatus for determining the position of an elevator car according to claim 19, wherein the current produced by said linear position transmitter has a first current value when the elevator car is level with the threshold of the landing door, and the current is greater than the first current value when the elevator car is below the threshold of the landing door and within the first door zone, and the current is less than the first current value when the elevator car is above the threshold of the landing door and within the first door zone.

21. The apparatus for determining the position of an elevator car according to claim 6, wherein said door zone magnet array includes a first magnet adjacent to a second magnet when considered in a direction of movement of the elevator car, and a third magnet adjacent to said first magnet at a side opposite from said second magnet.

22. The apparatus according to claim 6, wherein the first door zone is within the second door zone.

* * * * *